United States Patent [19]

Frank

[11] 4,114,844

[45] Sep. 19, 1978

[54] TONGUE SWITCH FOR RAIL INSTALLATIONS

[75] Inventor: Earl E. Frank, Tallman, N.Y.

[73] Assignee: Abex Corporation, New York, N.Y.

[21] Appl. No.: 870,357

[22] Filed: Jan. 18, 1978

[51] Int. Cl.[2] ..... B61L 5/10

[52] U.S. Cl. ..... 246/162; 246/217; 246/401

[58] Field of Search ..... 246/401, 476, 162, 176, 246/217, 220

[56] References Cited

U.S. PATENT DOCUMENTS 2,740,041 3/1956 Marcum ..... 246/162

*Primary Examiner*—Trygve M. Blix
*Assistant Examiner*—Reinhard J. Eisenzopf
*Attorney, Agent, or Firm*—Kinzer, Plyer, Dorn & McEachran

[57] ABSTRACT

Tongue switch positioning is monitored by circuitry to indicate the switch is obstructed.

3 Claims, 4 Drawing Figures

LS-1
LS-2
LS-3
LS-4
L-1
L-2
L-3
L-4
DS1
DS2
DS3
DS4
TDR
TD
FL
PB
LAMP TEST
NO
NC
10
12
14
16
18
20
22
24
24A
24T
26
26A
28
30
32
34
35A
35B
3

TONGUE SWITCH FOR RAIL INSTALLATIONS

This invention relates to a tongue switch associated with a rail installation.

There are a limited number of rail installations where the turn-out from the main track to the tangent track is governed by a pair of tongue switches rather than the more familiar so-called split switch where a pair of switch point rails, joined by one or more rods, are thrown in unison to govern traffic movement. In comparison, the tongue switch features a pair of pivotally mounted tongues each presenting a pair of rail sections to be aligned with either the main track or the tangent rails. The principal advantages from the standpoint of an industrial application is that some track gauges are so wide that the more familiar switch installation is not practical. In fact this very situation gives rise to the present invention because some of the industrial traffic governed by a tongue switch is of such a critical nature from the standpoint of weight or cargo that a switch malfunction can result in a catastrope. A gantry crane loading explosives near a residential site is a good example.

A switch malfunction is deemed to be a failure of either tongue to reside in one home position for directing traffic movement along the main track, or in the other home position for directing traffic movement into the turn-out.

Accordingly, the object of the present invention is to develop a detector system which monitors by direct contact both tongues resident in each of the home positions, rather than a detector sensing some other condition which, though it maybe a pertinent condition, may not necessarily be a conforming condition. Further objects of the invention are to develop a detector system which will indicate that the switch tongues are in transit between home positions, and to develop a detection system which will indicate the switch is blocked between home positions.

More specifically it is an object of the present invention to locate two limit switches respectively on opposite sides of each tongue, separated by the included angle of tongue movement between its home positions, each limit switch at one tongue being paired to a limit switch at the other tongue, corresponding to one of the home positions; the limit switches thus paired each have two pairs of normally closed contacts (normally closed when the tongues are in transit) arranged in parallel to one another but with the pairs themselves joined in a series circuit to a time delay relay which starts to time out when the tongues leave home position so that if the tongues do not arrive in the other home position with a predetermined time, a warning signal is given that an impedance has been encountered; otherwise, the time delay relay does not time out, its circuit is broken and preferably another indicator is joined in the same circuit to indicate the commencement of transit movement. Additional limit switch contacts are series connected to indicators which show that the tongues reside in one home position or the other.

IN THE DRAWING

Figures 1, 4:
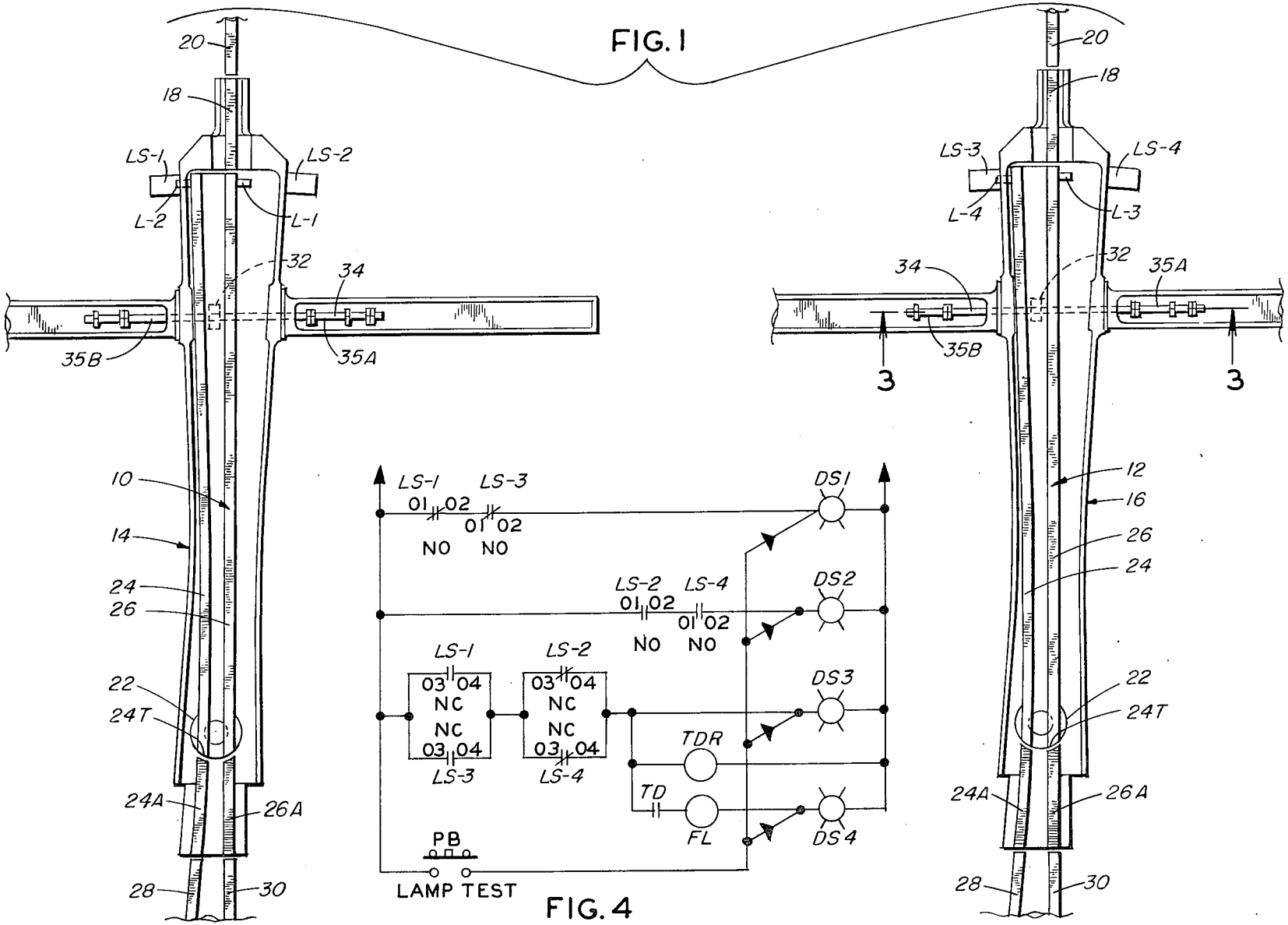
FIG. 1 is a fragmentary plan view of a switch system incorporating the present invention.
FIG. 4 is a wiring diagram.

A tongue switch installation on which the present invention may be based is shown in FIG. 1 comprising individual left and right hand tongues 10 and 12 located within cavities presented by corresponding switch bodies 14 and 16. The tongues may be cast of manganese steel; the switch bodies may be carbon steel castings.

Each of the switch bodies has a short rail section 18 cast integral therewith at what may be termed the heel end of the switch body and each rail section 18 is aligned with a main track rail 20.

The separation between the two main track rails 20 represents the gauge which in this instance may be thirty feet. The gauge may be considerably larger than that.

The tongues 10 and 12 are supported on pivots 22 at what may be termed the point end of each switch body. Each tongue is characterized by a pair of arms 24 and 26 constituting rail sections.

Each switch body, at the toe end, includes two additional short rail sections 24A and 26A integral with the switch body. The rail sections 24A and 26A are relatively divergent, which is to say that rail section 26A is aligned with the continuation 30 of the main rail, while section 24A is aligned with the turn-out rail 28.

The condition for the switch installation illustrated in FIG. 1 is straight through traffic movement, that is, the rail arms 26 of each tongue are aligned for traffic movement along the main rail 20–30 while, by throwing each switch tongue to its other home position, the tongue arms 24 have their heel ends presented to the track section 18, diverting the traffic to the turn-out rails 28. In this connection it should be stressed that there is a slight bow in the tongue arms 24 and that there is, during pivotal movement, scarcely any lateral displacement of the toe ends 24T of the rail arms 24 relative to the track sections 24A.

Figure 3:
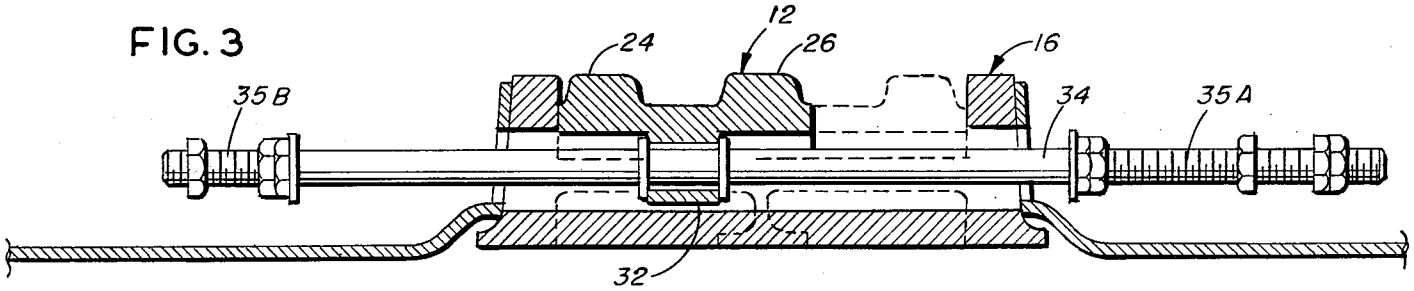
FIG. 3 is a sectional view taken on FIG. 2.

While it is possible to have the tongues joined by a throw rod so that they will be thrown in unison, there are other installations where the tongues are independently thrown and this is the form of switch installation illustrated in FIG. 1. Thus, it will be noted, FIG. 3, that tongue 12 is provided with an eye 32 through which a throw rod 34 is passed and secured thereto. One end portion of the throw rod, 35A, may have the piston of an air cylinder (not shown) connected thereto enabling tongue 12 to be automatically thrown. The opposite end 35B of the throw rod is adapted to have a link connected thereto which in turn may be associated with a hand throw lever, not shown.

Both tongues are identical in configuration and consequently the description above (FIG. 3) applies equally well to tongue 10 and indeed, as shown in FIG. 1, the same reference numerals would apply in defining the manner in which tongue 10 is operated independently of tongue 12.

In accordance with the present invention, the two home positions of each tongue may be monitored by limit switches, lighting a lamp (or energizing any other visible signal, either at the switch site or a remote traffic control site) when the home position is attained, lighting another lamp when the tongues are in motion between home positions, and lighting yet another lamp if a home position is not attained within a predetermined time limit.

Thus, as shown in FIG. 1, the heel of each tongue is monitored by a pair of limit switches located on opposite sides thereof: limit switches LS-1 and LS-2 assigned to tongue 10, and limit switches LS-3 and LS-4 assigned to tongue 12. The precise spanning dimension for the monitors is not critical of course but the greatest tongue movement is at the heel. In this connection it may be mentioned that the pivot for each tongue is displaced only a slight distance from the point end of the tongue and when the tongues are "thrown" from the position shown in FIG. 1 (traffic straight through) to the other home position (traffic diverted to the tangent track) there is scarcely any change in the position of the end 24T of arm 24 which remains aligned with the tangent or turn-out rail section 24A.

Figure 2:
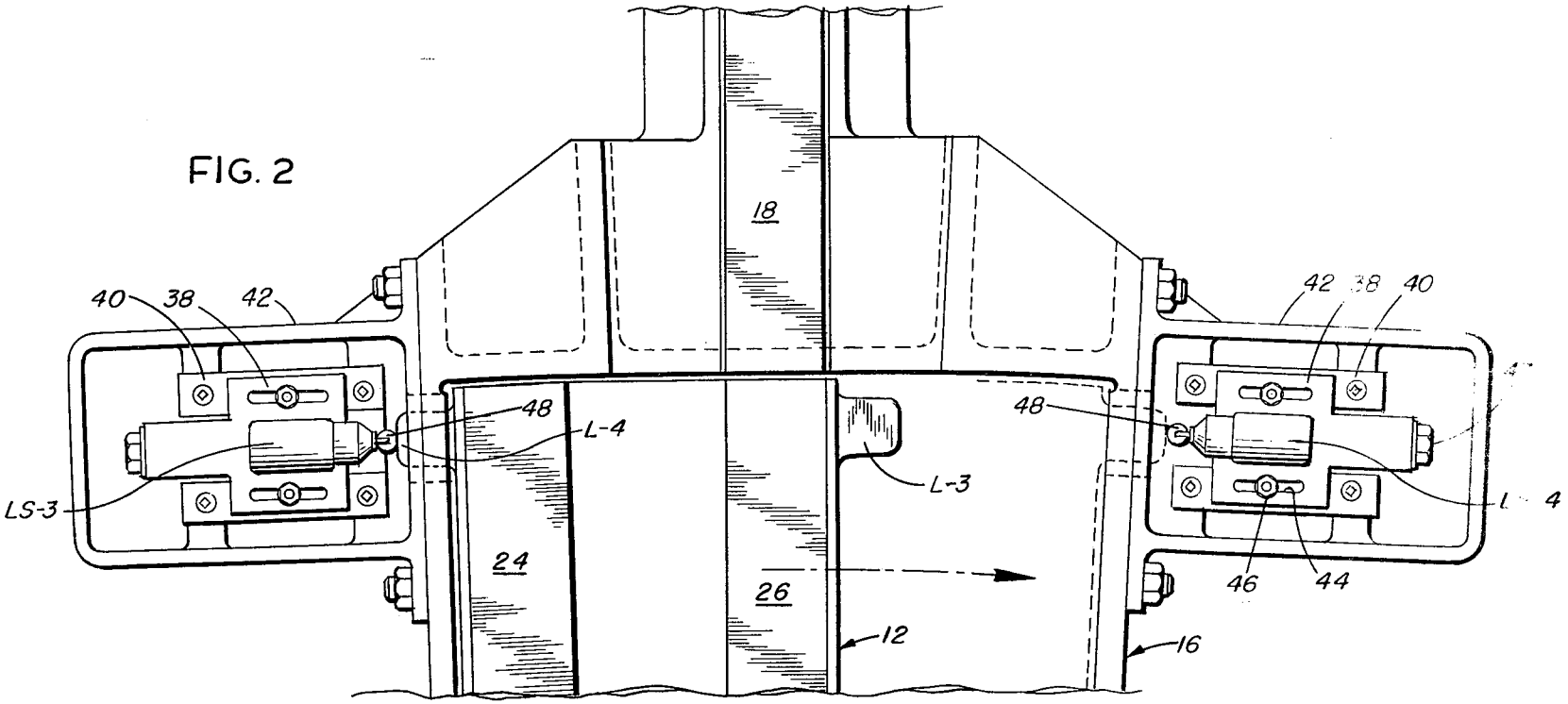
FIG. 2 is an enlarged fragment of a portion of FIG. 1, showing more detail.

To actuate the limit switches, the tongues are provided with respective lugs L-1 and L-2, L-3 and L-4. As shown in FIG. 2, each limit switch includes a switch base plate 38 supported on a support plate 40 contained in a switch housing 42.

The switch base plate 38 is slotted at 44 and cap screws are provided in order that the actuator 48 of each limit switch may be approximately adjusted to the limit of the throw of the tongue heel lug. Precise adjustment is attained by an adjusting screw 47. The details shown in FIG. 2 apply equally well to limit switches LS-1 and LS-2 assigned to the heel lugs L-1 and L-2 of tongue 10.

Limit switches LS-2 and LS-4 are paired in that the actuator of each is engaged by its respective tongue lug in the home position shown in FIG. 1. In other words, the spacing between opposed limit switch actuators corresponds to the included angle of switch tongue movement between home positions. Likewise, limit switches LS-1 and LS-3 are paired in that the actuator of each is to be engaged by the respective tongue lug in the other home position.

Operation of the limit switch contacts will be described in terms of the limit switch being held in one's hand, constituting the "normal" position of the switch as manufactured. The normal position for any particular set of contacts may be normally open, or normally closed, denoted by NO and NC, FIG. 4. An equivalent circuit may be possible in terms of the series and parallel connections now to be described in detail.

Switches LS-1 and LS-3 have a first set of normally open contacts (01-02, 01-02) in a series circuit to a first signal element DS1 (lamp) to signify visibly that the tongue is in one of its home positions when those sets of contacts are closed by the tongue in the corresponding home position.

Switches LS-2 and LS-4 also have a first set of normally open contacts (01-02, 01-02) in a series circuit to a second lamp DS2 to signify visibly that the tongue is in the other of its home positions when those sets of contacts are closed by the tongue in the corresponding home position.

The circuit thus far described conforms to the condition shown in FIG. 1. With the tongues located as shown, the normally open contacts 01-02, 01-02 of switches LS-1 and LS-3 are closed by the lugs engaging the actuators; the other sets remain normally open and when the tongues are thrown to the other position, the contacts are reversed.

Switches LS-1 and LS-3 have two pairs of normally closed contacts (03-04, 03-04) in parallel, and switches LS-2 and LS-4 also have two pairs of normally closed contacts (03-04, 03-04) in parallel, together combined in a series circuit to a third signal element DS3 to signify when the tongues are in transit between home positions. All four parallel contacts are closed during transit but two of the pairs of parallel contacts will open when the tongue is in home position.

Again FIG. 1, when the tongues are in the position shown, parallel contact pairs 03-04 and 03-04 of switches LS-1 and LS-3 are opened; those of switches LS-2 and LS-4 are in the normally closed state, because there is no tongue lug engaging the actuators of those switches, but when the tongue starts its transit all the contacts in the circuit for DS3 are closed and indicator DS3 is energized, and when the other home position is attained the parallel contacts reverse, extinguishing signal lamp DS3.

The time delay relay TDR has a set of normally open contacts TD in a series circuit to a fourth signal element DS4. The relay TDR times out (is fully energized) and its contacts TD close after a predetermined time lapse deemed determinative of failure timely to locate a tongue in home position but when both tongues timely attain home position relay TDR is cut out along with signal element DS4. Lamp DS4 may include a flasher control FL.

It will be recognized from the foregoing that the electrical circuit, FIG. 4, is arranged to remotely indicate the proper alignment of a pair of switch tongues independently operated. In the event either one of the tongues does not complete its throw, either because of a system malfunction or an obstruction at the switch installation, a flashing lamp, DS4, is energized. Since an obstruction may occur at one of the switch bodies and not the other, and since there may be a malfunction in one of the automatic throw mechanisms attached to shaft 34 but not the other, a failure of either one of the tongues to attain home position within the time allotment results in energization of the time delay relay.

At any time when the switch installation is idle, one or the other lamps DS1 or DS2 will be illuminated to indicate the position of the switch. On the other hand, when the switch is in transit both lamps DS1 and DS2 will be extinguished while lamp DS3 will be lit.

A momentary push button switch PB may be utilized to make lamp tests from time to time.

I claim:

1. In a track installation where pivotal tongue switches are interposed between the main track and the tangent track to govern traffic: a system to indicate the position of the tongues and comprising two limit switches positionable on opposite sides of each tongue and having actuators separated by the included angle of tongue movement between the home position of each tongue, each limit switch at one tongue being paired to a limit switch at the other tongue corresponding to a home position; the limit switches thus paired each having two pairs of normally closed contacts arranged in parallel to one another which open only when the tongues are in home position, the two pairs of parallel contacts of one limit switch being joined in series to the two pairs of parallel contacts of the other limit switch and the respective pairs being series-connected to a time delay relay which thereby starts to time out as the tongues are in transit, and said time delay relay having normally open contacts series-connected to an indicator which is energized by closure of the time delay relay contacts if the tongues are too long in transit.

2. System according to claim 1 in which the paired limit switches have respective sets of normally open contacts, closed when the tongues are in respective home positions, joined in series to respective indicators indicating the home position in which the tongues reside.

3. System according to claim 2 in which the two pairs of normally closed contacts are series connected to an indicator to indicate the tongues are in transit.

* * * * *